US007208879B2

(12) United States Patent
Kika

(10) Patent No.: US 7,208,879 B2
(45) Date of Patent: Apr. 24, 2007

(54) LIGHTING APPARATUS FOR DISCHARGE LAMP

(75) Inventor: Manabu Kika, Kamakura (JP)

(73) Assignee: Harison Toshiba Lighting Corporation, Ehime (JP)

( * ) Notice: Subject to any disclaimer, the term of this patent is extended or adjusted under 35 U.S.C. 154(b) by 67 days.

(21) Appl. No.: 11/124,205

(22) Filed: May 9, 2005

(65) Prior Publication Data

US 2005/0248290 A1 Nov. 10, 2005

(30) Foreign Application Priority Data

May 10, 2004 (JP) ..... 2004-139895
Apr. 13, 2005 (JP) ..... 2005-115977

(51) Int. Cl.
*H01J 13/46* (2006.01)

(52) U.S. Cl. ..... 315/57; 315/70; 315/276; 315/291

(58) Field of Classification Search ..... 315/56–57, 315/307–308, 224, 291, 70, 212, 219, 244, 315/246, 254, 262, 274, 276, 326, 354
See application file for complete search history.

(56) References Cited

U.S. PATENT DOCUMENTS 6,066,921 A * 5/2000 Nakamura et al. ..... 315/71
6,429,591 B1 * 8/2002 Takamatsu et al. ..... 315/56
6,661,176 B2 * 12/2003 Honda et al. ..... 315/56
2002/0014865 A1 * 2/2002 Akimoto et al. ..... 315/291
2002/0074955 A1 * 6/2002 Yuda et al. ..... 315/307
2003/0137260 A1 * 7/2003 Ohsawa ..... 315/291
2003/0173910 A1 * 9/2003 Suzuki ..... 315/291
2004/0004438 A1 * 1/2004 Deguchi et al. ..... 313/637
2005/0040768 A1 * 2/2005 Kato et al. ..... 313/635

FOREIGN PATENT DOCUMENTS

JP 2004-206974 7/2004

* cited by examiner

*Primary Examiner*—Hoanganh Le
*Assistant Examiner*—Tung Le
(74) *Attorney, Agent, or Firm*—DLA Piper US LLP

(57) ABSTRACT

An embodiment of a discharge lamp lighting apparatus of the present invention includes a socket inserted with a discharge bulb, a transformer having a coil including a secondary side winding connected at one end to the socket, connected at the other end to a first drive wire, and a primary side winding connected at one end to a second drive wire, connected at the other end to a third drive wire through a discharge gap, a core inserted into the coil, and a resin filled between the core and the primary side winding, the secondary side winding, and a capacitor connected between the second drive wire and the third drive wire, wherein the transformer and the socket are aligned side by side.

16 Claims, 7 Drawing Sheets

LIGHTING APPARATUS FOR DISCHARGE LAMP

CROSS-REFERENCE TO RELATED APPLICATION

The present invention contains subject matter related to Japanese Patent Application JP 2004-139895 filed in the Japanese Patent Office on May 10, 2004, and Japanese Patent Application JP 2005-115977 filed in the Japanese Patent Office on Apr. 13, 2005, the entire contents of which being incorporated herein by reference.

BACKGROUND OF THE INVENTION

1. Field of the Invention

The present invention relates to a discharge lamp lighting apparatus which is desired to be thin in a depth direction, such as a headlight of an automobile.

2. Description of the Related Art

Recently, a discharge lamp having high luminance has been used for a headlight, etc. of an automobile. In order to secure a space of an engine room when a high luminance discharge lamp is used for the head light of the automobile, a thickness of the discharge lamp in a depth direction from a socket is desired to be as thin as possible.

However, in a general high luminance discharge lamp, an igniter is connected to the socket of the discharge lamp, but this igniter needs a transformer which has a relatively large volume. Therefore, there is a problem that a lighting unit including the socket and the igniter becomes thick.

Therefore, as shown in Japanese Patent Application Laid-Open Publication No. 2004-206974 (Patent Document 1), it is considered that a drawing direction of a wiring for a drive wire is directed to a direction of a socket engaging surface so as to thin the lighting unit.

However, since a discharge bulb exists in the drawing direction of the drive wire if thus constructed, it is necessary to bend largely the drawn drive wire, and there are problems in view of workability and durability. When a normally used transformer is used as the igniter, there is possibility that a creeping discharge and a corona discharge occurs at a secondary side winding by a voltage generated in this winding, and a power supplied to the discharge bulb is limited. Therefore, there are problems that a high voltage cannot be applied to the discharge lamp and start of lighting the discharge lamp cannot be easily and speedily performed.

SUMMARY OF THE INVENTION

It is an object of the present invention to provide a discharge lamp lighting apparatus suitable for use in a headlight of an automobile.

According to an aspect of the present invention, there is provided a discharge lamp lighting apparatus comprising a socket inserted with a discharge bulb, a transformer having a coil including a secondary side winding connected at one end to the socket, connected at the other end to a first drive wire, and a primary side winding connected at one end to a second drive wire, connected at the other end to a third drive wire through a discharge gap, a core inserted into the coil, and a resin filled between the core and the primary side winding, the secondary side winding, and a capacitor connected between the second drive wire and the third drive wire, wherein the transformer and the socket are aligned side by side.

DETAILED DESCRIPTION IN THE INVENTION

The embodiments of the present invention will be described with reference to the accompanying drawings. As will be described later, one of the features of the present invention is the relationship between a socket inserted with a discharge bulb and a transformer of an igniter connected to this socket. To facilitate easy understanding of the present invention, prior to describing details of the feature of the embodiment of the present invention, an electrical circuit of a discharge lamp lighting apparatus will be described.

Figure 1:
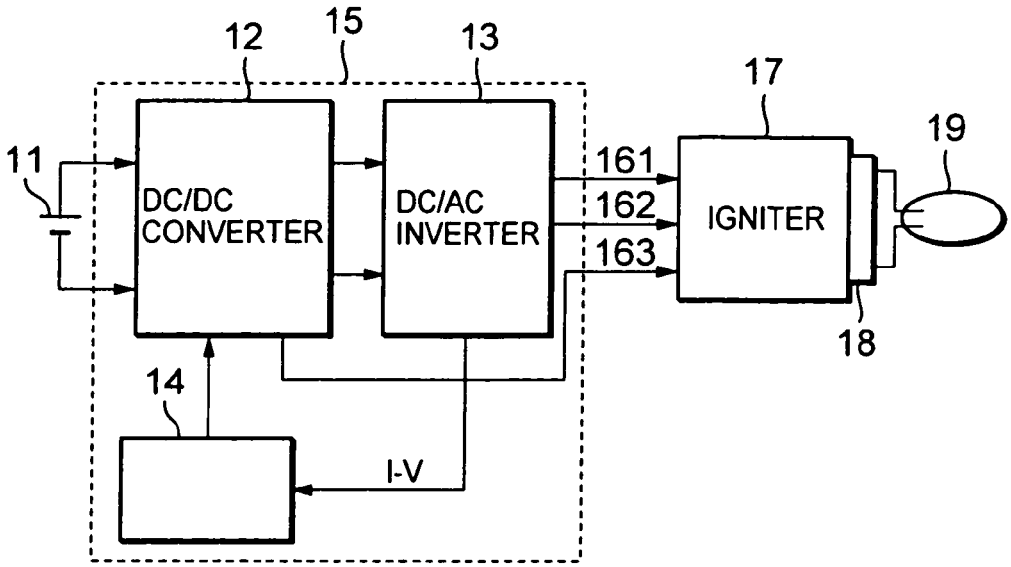
FIG. 1 is a view showing a circuit configuration example of a discharge lamp lighting apparatus according to an embodiment of the present invention.

In FIG. 1, reference numeral 11 designates a DC voltage source, and a voltage of this voltage source 11 is supplied to a DC/DC converter 12. The voltage of the DC voltage source 11 is pressurized to, for example, about 360–400V in the DC/DC converter 12. The pressurized voltage is supplied to a DC/AC inverter 13, subjected to switching operation at several hundreds Hz in a full-bridge circuit using, for example, four switching elements, thereby generating a rectangular wave.

Reference numeral 14 shows a control circuit, which obtains a power from an output current I and a voltage V generated from the DC/AC inverter 13 and controls the power generated from the DC/DC converter 12 to become constant at 35 W, for example. The DC/DC converter 12, the DC/AC inverter 13 and the control circuit 14 constitutes an inverter 15.

The inverter 15 outputs DC voltages of, for example, 400V and 1 kV. In the inverter 15, the DC/AC inverter 13 transmits a voltage of 400V to an igniter 17 by using drive wires 161 and 162. The DC/DC converter 12 transmits a voltage of 1 kV to the igniter 17 by using a drive wire 163. The drive wires 161 to 163 may be collectively shielded, or the drive wires individually shielded, are used.

Figure 2:
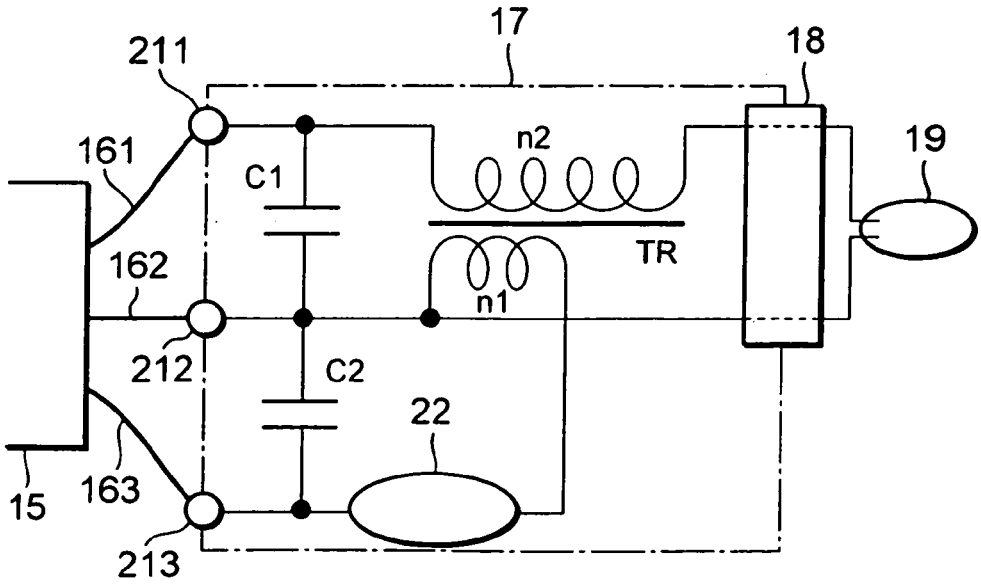
FIG. 2 is a view for explaining a structure of an igniter in the circuit configuration shown in FIG. 1 in detail.

Reference numeral 18 denotes a socket formed integrally with the igniter 17, and engaged, for example, with an HID bulb 19, that is, a discharge bulb, to supply a high-pressure pulse voltage generated from the igniter 17. FIG. 2 shows an example of an electrical circuit diagram of the igniter 17 shown in FIG. 1.

More particularly, reference numerals 211 to 213 designate connecting terminals electrically connected to the drive wires 161 to 163 taken out from the inverter 15. The connecting terminals 211, 212 and 213 are respectively connected to the drive wires 161, 162 and 163. The connecting terminal 211 is connected to one end of a capacitor C1, and connected to one end of a secondary side winding of an open magnetic circuit type transformer TR composed of a slender core having an end face.

The connecting terminal 212 is connected to the other end of the capacitor C1, and one ends of a capacitor C2 and a primary side winding of the transformer TR, respectively. The connecting terminal 213 is connected to the other end of the capacitor C2 and connected to the other end of the secondary side winding of the transformer TR through a discharge gap 22. The other end of the secondary side winding of the transformer TR is connected to one electrode of the HID bulb 19 through the socket 18. The connecting terminal 212 is connected to the other electrode of the HID bulb 19 through the socket 18.

The socket 18 of the igniter 17 is formed in a shape which can be engaged directly with a mouthpiece of the HID bulb 19, and the transformer TR is disposed at the end of the socket 18. The inverter 15 is contained in a metal case, and executed with a magnetically shielded. The igniter 17 is, for example, magnetically shielded.

Figure 3:
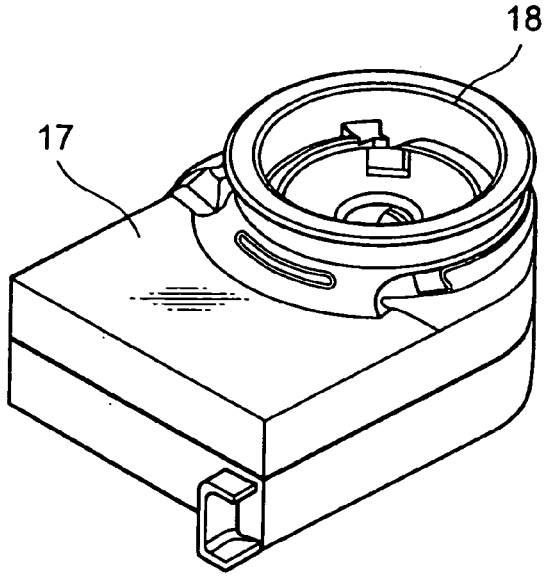
FIG. 3 is a perspective view showing an appearance of a lighting unit according to the embodiment of the present invention.

FIG. 3 shows a perspective view of an example of a configuration according to one embodiment of the present invention of the igniter 17 shown in FIG. 2 in which the the socket 18 and the cover are attached. In FIG. 3, the drive wires 161, 162 and 163 are removed, and not shown.

Figure 4:
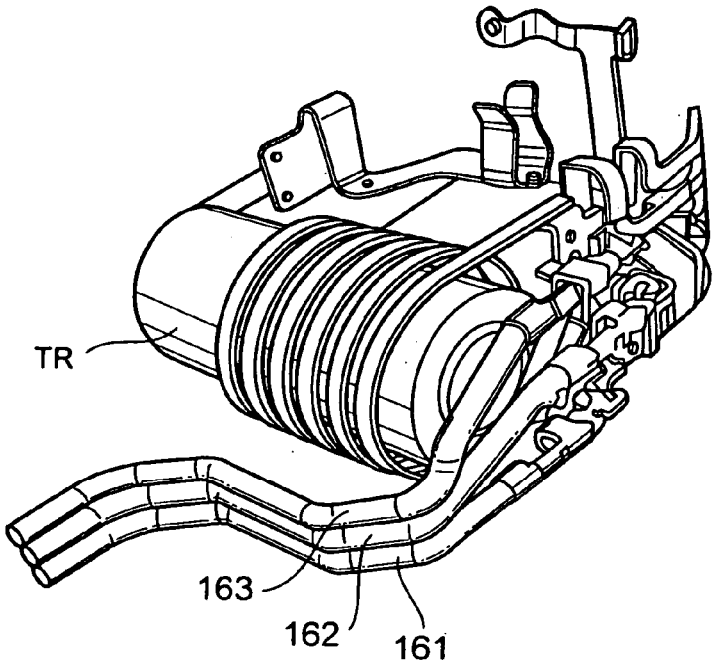
FIG. 4 is a perspective view showing an internal structure of the lighting unit of one embodiment of the present invention.
Figure 5:
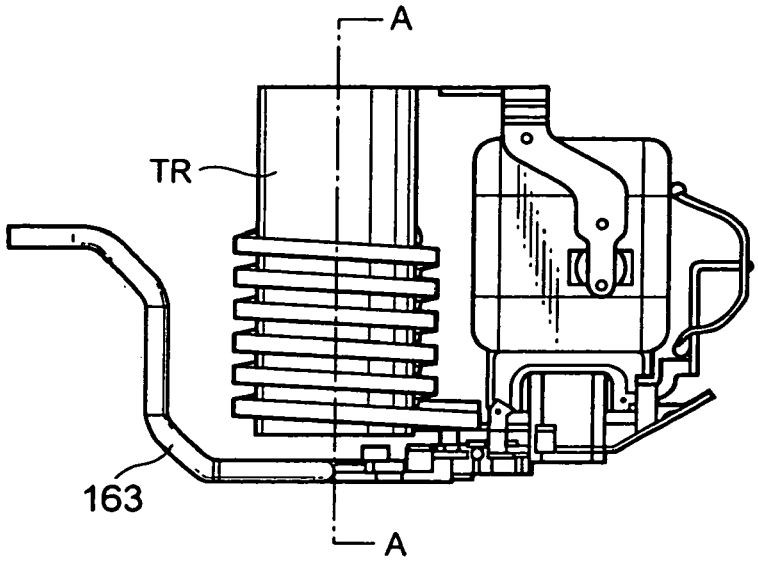
FIG. 5 is a plan view showing a structure of the lighting unit according to the embodiment of the present invention.

FIG. 4 shows the structure that the cover of the igniter 17 in FIG. 3 is removed. FIG. 4 shows the drive wires 161, 162 and 163. FIG. 5 shows a plan view of the structure of the igniter 17 and the socket 18 shown in FIG. 4 as seen from above, and FIG. 6 shows a sectional view taken along line A—A of the transformer TR shown in FIG. 5.

Figure 6:
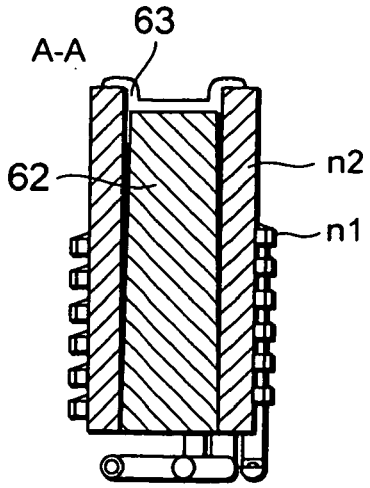
FIG. 6 is a view showing a section taken along line A—A of a transformer TR of the lighting unit of FIG. 5.

As shown in FIG. 6, the transformer TR has a structure that a secondary side winding n2 having the same diameter is wound around a periphery of a bar-like core 62 having a taper thin at an upper part and thick at a lower part and a primary side winding n1 is wound around the secondary side winding n2. A high voltage is generated at an upper end of the secondary side winding n2 connected to one terminal of the socket 18. At the upper end of the transformer TR, the secondary side winding n2 is more protruded than the bar-like core 62. A resin 63 is filled between the bar-like core 62 and the secondary side winding n2 and an upper recess part of the secondary side winding n2 and the bar-like core 62. As a material of this resin 63, gel, epoxy, silicone, urethane, etc., are, for example, used.

Figure 7:
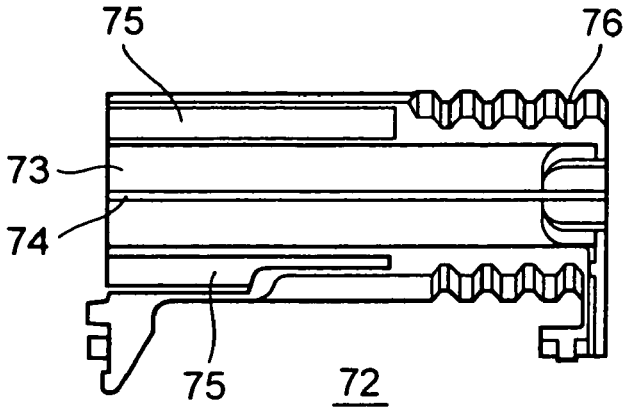
FIG. 7 is a sectional view showing a structure of a bobbin made of resin according to the embodiment of the present invention.
Figure 8:
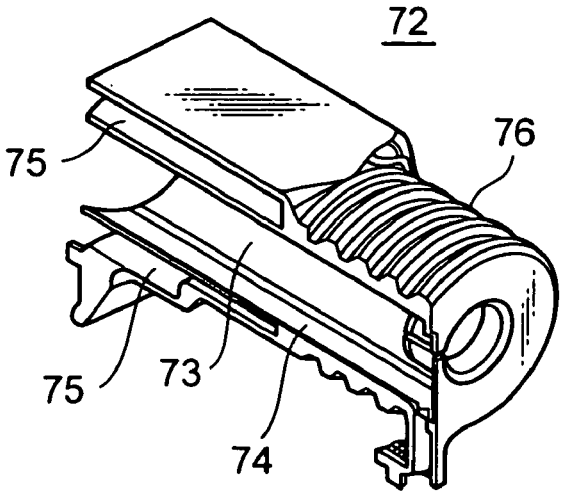
FIG. 8 is a partially cutout perspective view showing the structure of the bobbin made of resin according to the embodiment of the present invention.
Figure 9:
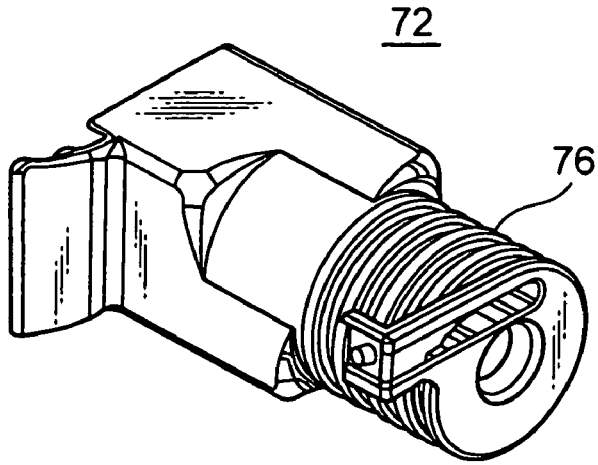
FIG. 9 is a partially cutout perspective view as seen from the other direction showing the structure of the bobbin made of resin according to the embodiment of the present invention.
Figure 10:
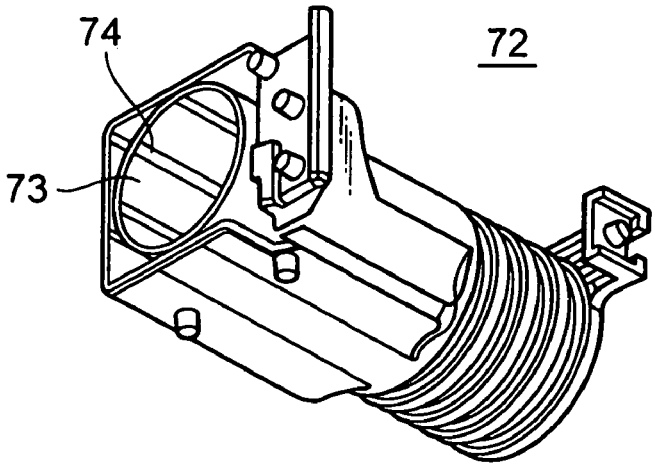
FIG. 10 is a perspective view as seen from further another direction showing the structure of the bobbin made of resin according to the embodiment of the present invention.

In fact, the primary side winding and the secondary side winding of the transformer TR are not directly laminated, but are laminated through a bobbin made of resin of a predetermined shape. A sectional view of such a bobbin 71 is shown in FIG. 7, and its partially cutout perspective view is shown in FIG. 8. FIG. 9 and FIG. 10 show the structure of this bobbin made of resin. In FIG. 7 and FIG. 8, a central cavity 73 in which the bar-like core 62 and the secondary side winding are inserted, is provided at a center of the bobbin 72 made of resin. A plurality of ribs 74 as inwardly-directed projections are axially provided on a surface of the central cavity 73.

Reference numeral 75 designates a cavity for a winding with a bottom in which the primary winding n1 of the transformer TR is engaged, and reference numeral 76 shows a groove for lengthening a creeping distance.

Since the above-mentioned ribs 74 are provided, even after the bar-like core 62 and the secondary side winding n2 are inserted, a gap can be secured at the inside of the secondary side winding and the bobbin 72 made of resin. Therefore, the resin can be easily filed in this gap from the exterior.

As the material for the above-mentioned primary side winding n1, a hard material, such as, a stainless steel is used. When the hard material is used as the primary side winding n1, this primary side winding can be easily inserted into the cavity 75 for winding.

The igniter 17 shown in FIG. 2 is constructed by using the transformer TR of the above-mentioned structure, and the discharge lamp lighting apparatus shown in FIG. 1 is constructed by using this igniter 17.

An operation of the discharge lamp lighting apparatus will be described. A voltage of 400V is applied to the connecting terminals 211 and 212 of the igniter 17 from the output of the inverter 15, and a voltage of about 1 kV is applied to the connecting terminal 213. Thus, charging for the capacitor C2 is started, and when it reaches the discharge breakdown voltage of the discharge gap 22, a current flows to the primary side winding of the transformer TR, and a pulse voltage of, for example, 20 kV is generated in the secondary side winding.

From the relationship that a voltage in proportion to a ratio of a turns ratio n1 of the primary side winding and a turns ratio n2 of the secondary side winding is generated at the secondary side of the transformer TR, a high voltage of, for example, 20 kV is generated in the secondary side winding by setting the respective turns ratios to the relation of n1<n2. This voltage is supplied to the HID bulb 19, and discharging of the HID bulb 19 is started.

When the discharging of the HID bulb 19 is started, the voltage supplied to the connecting terminals 211 and 212 becomes stable at a voltage near about 43V, and thereafter, the HID bulb 19 is driven through the igniter 17 to continue lighting.

Incidentally, the capacitor C1 is used so as not to circulate the high voltage generated at the secondary side winding of the transformer TR to the inverter side through the connecting terminal 212. The capacitor C1 is provided at the igniter 17, alternatively, however, it may be provided in the inverter 15.

As described above, the current flows only at the lighting starting time of the discharge lamp to the primary side winding n1 of the transformer TR, and a low resistance is not required as the secondary side winding. Therefore, from this point, an elastic material, such as a spring material can be used as the primary side winding.

The bobbin 72 made of resin that shows a cross section in FIG. 7 is used. The bobbin 72 made of resin has a structure that the primary side winding is provided on the outer periphery of the secondary side winding, and an opening for inserting the primary side winding is provided at the side not for generating the high voltage of the secondary side winding.

When the transformer TR is thinned at the end of the side for generating the high voltage of the secondary side winding n2 of the bar-like core 62 as shown in FIG. 6 and this side is filled with thick resin, a corona discharge and a creeping discharge can be prevented. On the other hand, even if the diameter of the bar-like core is thickened at the lower side of the secondary side winding n2 shown in FIG. 6, that is, at the side for not generating the high voltage, discharge is not generated, and the maximum output can be secured. Since this end is normally a ground potential and discharge is not generated, even when the secondary side winding is exposed at this portion, it does not become a starting point of a creeping discharge.

As shown in FIG. 6, since the length of the bar-like core is shorter than that of the secondary side winding n2, a section at the end for generating the high voltage is recessed, and the resin 63 is sufficiently filed in the inside of the coil, generation of the creeping discharge and the corona discharge can be prevented.

In the above-mentioned embodiment, as shown in FIG. 6, the secondary side winding n2 has the same diameter, and the taper is provided at the bar-like core 62. However, in the present invention, the transformer TR can be constructed by using the bar-like core having the same diameter and a secondary side winding n2 that has the larger diameter at the side for generating the high voltage. In brief, if the gap between the secondary side winding and the bar-like core is enlarged, at the side for generating the higher voltage, and the resin is filed in this portion, it is appropriate as the transformer TR used in the present invention.

Incidentally, the transformer used for the igniter in the discharge lamp lighting apparatus of the above-mentioned embodiment has the structure that the primary side winding is wound around the secondary side winding. However, the transformer of the embodiment can have the structure that the primary side winding and the secondary side winding are aligned side by side.

Next, another embodiment of the present invention using the transformer of such a structure will be described. FIG. 11A to FIG. 11E show a configuration example of a transformer in a discharge lamp lighting apparatus according to another embodiment of the present invention.

Figure 11A:
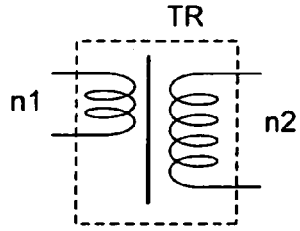
FIG. 11A is an electrical configuration diagram of a transformer TR in another embodiment of the present invention.
Figure 11B:
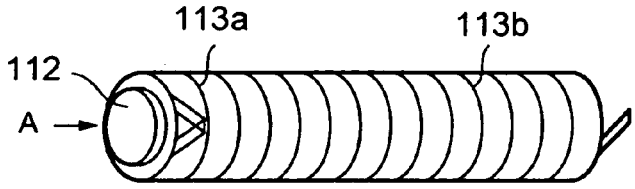
FIG. 11B is a view of an appearance of the transformer TR.
Figure 11C:
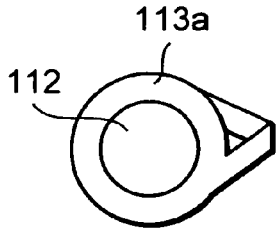
FIG. 11C is a view of the transformer TR as seen from a direction A in FIG. 11B.
Figure 11D:
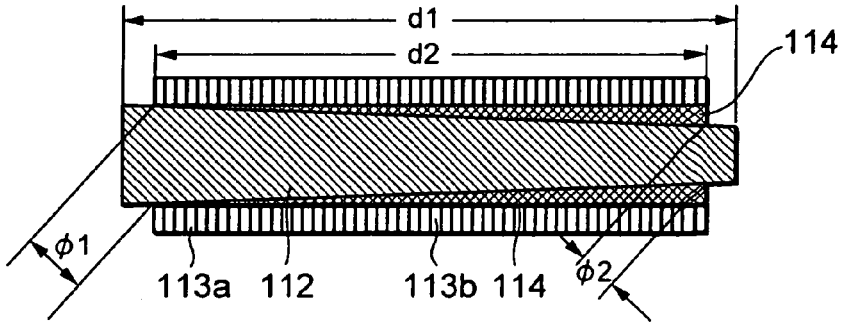
FIG. 11D is a sectional view of the transformer TR.
Figure 11E:
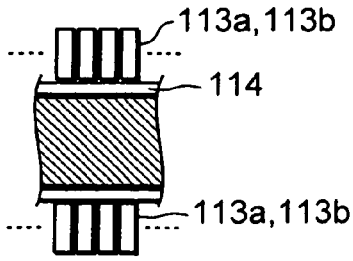
FIG. 11E is an enlarged sectional view of a winding portion of the transformer TR shown in FIG. 1D.

FIG. 11A shows an electrical configuration of the transformer TR, FIG. 11B shows an appearance of the transformer TR, FIG. 11C is a view of the transformer TR as seen from a direction A in FIG. 11B, FIG. 11D is a sectional view of the transformer TR, and FIG. 11E is an enlarged sectional view of the winding portion of the transformer TR shown in FIG. 11D.

The transformer TR includes a bar-like core 112 having a taper (described later), a primary side winding 113*a* and a secondary side winding 113*b* of a turns ratio of n1 to n2, wound around the bar-like core 112, and a resin 114 filled between these primary side winding 113*a*, the secondary side winding 113*b* and the bar-like core 112. The primary side winding 113*a* and the secondary side winding 113*b* have, as shown in FIG. 11E, a flat plate shape to the cross-sectional direction of the bar-like core 112, and wound in one layer on the resin 114 of the bar-like core 112.

Regarding dimensions, a length d1 of the bar-like core 112 is 30.0 mm, the entire length d2 of the primary side coil and the secondary side coil is 28.0 mm, and a turns ratio n1:n2 of the primary side winding 113*a* and the secondary side winding 113*b* is, for example, 3 turns to 200 turns.

The bar-like core 112 has a so-called taper shape that the primary side winding 113*a* is thick and the secondary side winding 113*b* is thin. Dimensions of the bar-like core 112 are: for example, a diameter $\phi$1 of the primary side winding 113*a* is 8.0 mm; and a diameter $\phi$2 of the secondary side winding 113*b* is 7.9 mm.

To manufacture the transformer TR of the above-mentioned structure, firstly, the bar-like core 112 having a predetermined taper is manufactured. Then, a coil having the primary side winding 113*a* and the secondary side winding 113*b* and having a predetermined diameter is manufactured. Subsequently, the bar-like core 112 is passed through from the secondary side winding 113*b* of the coil and fixed. Then, the resin 114 is filled and sealed from the secondary side winding of the coil between the coil and the bar-like core 112.

When thus manufactured, it is easy to pass the bar-like core 112 through the coil. Further, since the resin is filed between the coil and the bar-like core having a relatively large space, there are advantages that filling of the resin is easy, and further a transformer for effectively preventing a discharge can be manufactured relatively simply.

The transformer TR having the structure shown in FIG. 11A, can be used for the igniter shown in FIG. 2 in the discharge lamp lighting apparatus of the circuit shown in FIG. 1, for example.

Figure 12:
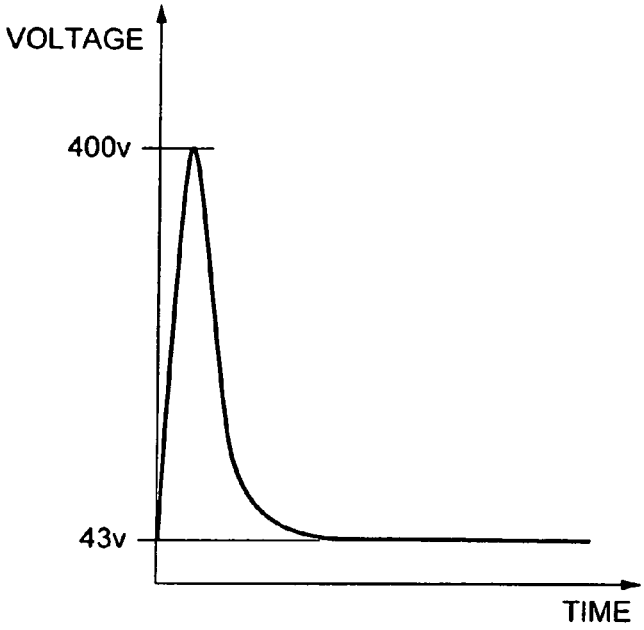
FIG. 12 is a view for explaining an operation of the igniter shown in FIG. 3.

Next, a circuit operation of the case that the transformer TR having the structure shown in FIG. 11B to FIG. 11E is used for the igniter shown in FIG. 2, will be described also with reference to FIG. 12. That is, a pulse voltage of 400V as shown in FIG. 12 is applied to the connecting terminals 211 and 212 of the igniter 17 from the output of the inverter 15 shown in FIG. 1, and a voltage of 1 kV is applied to the connecting terminal 213. Thus, charging for the capacitor C2 is started, and when it reaches the discharge breakdown voltage of the discharge gap 22, a current flows to the primary side winding of the transformer TR, and a pulse voltage of, for example, 20 kV is generated in the secondary side winding.

From the relationship that a voltage in proportion to a ratio of a turns ratio n1 of the primary side winding and a turns ratio n2 of the secondary side winding is generated at the secondary side of the transformer TR, a high voltage of, for example, 20 kV is generated in the secondary side winding by setting the respective turns ratios to the relation of n1<n2. This voltage is supplied to the HID bulb 19, and discharging of the HID bulb 19 is started.

When the discharging of the HID bulb 19 is started, the voltage supplied to the connecting terminals 211 and 212 becomes stable at a voltage near about 43V, as shown in FIG. 12, and the HID bulb 19 is driven with this voltage to continue lighting.

According to the above-mentioned embodiment of the present invention, the bar-like core 2 has the taper, and a higher voltage is induced toward the end of the secondary side winding, and the larger amount of resin is sealed toward the end, and, therefore, the creeping discharge or the corona discharge is hardly generated. In addition, the diameter of the primary side winding 13*a* of the bar-like core 2 is large, that is, since the thick core is used in this portion, there are effects that the inductance can be increased, and a high voltage pulse can be easily generated.

Furthermore, since the coil of the primary side winding and the secondary side winding is formed in the flat plate shape toward the cross-sectional direction of the bar-like core, there are advantages that the number of turns of the winding to the length of the wound coil can be increased, and the high voltage pulse can be easily generated.

Figure 13A:
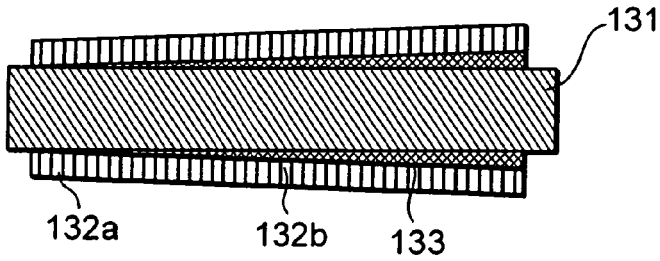
FIG. 13A is a sectional view showing a structure of a transformer of still another embodiment of the present invention.

In the transformer TR of the igniter used in the present invention, even when the taper is not incorporated in the bar-like core as shown in FIG. 11D, it suffices if the resin filled between the coil wound around the outside of the core and the bar-like core is thicker at the high voltage side of the secondary side winding than at the low voltage side of the primary side winding. A sectional view of still another embodiment of the transformer used in the present invention is shown in FIG. 13A. In this example, the bar-like core does not have a taper. Coils 132*a* and 132*b* of the primary side winding and the secondary side winding having a taper at least in the inside diameter are wound around the bar-like core 131 of the same diameter, and a resin 133 is filled between these cols and the bar-like core.

According to this embodiment, there is an advantage that the bar-like core having the same diameter that is easily manufactured can be used.

Figure 13B:
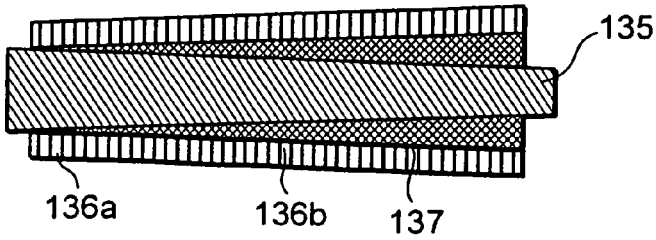
FIG. 13B is a sectional view showing the structure of the transformer of the further another embodiment of the present invention.

A sectional view of still another embodiment of the transformer used in the present invention is shown in FIG. 13B. In this example, coils 136*a* and 136*b* of the primary side winding and the secondary side winding having a taper are wound around the bar-like core 135 having a taper, and a resin 137 is filled between these coils and the bar-like core. According to this embodiment, space between the core of the secondary side winding and the coil can be easily separated, therefore, there is an advantage that the transformer suitable in the case that a very large voltage is induced at the end of the secondary side winding, is obtained.

The relationship between the bar-like core and the winding shown in FIG. 13A and FIG. 13B can be applied to the case of the first embodiment of the structure shown in FIG. 6.

In the above-mentioned embodiment, the cross section of the bar-like core is a round shape. However, the cross section may be a rectangular shape, a polygonal shape, or the like.

The present invention is not limited to the embodiments described above, but various changes and modifications can be implemented within a scope of technical thought of the present invention.

What is claimed is:

1. A discharge lamp lighting apparatus, comprising:

a socket adapted to receive a discharge bulb;

a transformer having a coil including a secondary side winding connected at one end to the socket and connected at the other end to a first drive wire, and a primary side winding connected at one end to a second drive wire and connected at the other end to a third drive wire through a discharge gap, a core inserted into the coil, and a resin filled between the core and the primary side winding and the secondary side winding; and a capacitor connected between the second drive wire and the third drive wire, wherein the transformer and the socket are aligned side by side, and wherein the primary side winding is wound on the secondary side winding, the secondary side winding protruding from the core at a high voltage generating side of the secondary side winding, and at least the high voltage generating side of the core and the secondary side winding being covered with the resin.

2. A discharge lamp lighting apparatus, comprising:

a socket adapted to receive a discharge bulb;

a transformer comprising:

a coil including a secondary side winding connected at one end to the socket and connected at the other end to a first drive wire, and a primary side winding connected at one end to a second drive wire and connected at the other end to a third drive wire through a discharge gap, a core inserted into the coil, and a resin filled between the core and the primary side winding and the secondary side winding, and a bobbin made of resin having a cavity at a center of the bobbin, an opening at an end of the secondary side winding not generating a high voltage, and a bottom cavity engaged with the primary side winding at a periphery of the bottom cavity; and a capacitor connected between the second drive wire and the third drive wire, wherein the transformer and the socket are aligned side by side.

3. The discharge lamp lighting apparatus according to claim 2, wherein the primary side winding is composed of a stainless steel.

4. A discharge lamp lighting apparatus, comprising:

a socket adapted to receive a discharge bulb;

a transformer having a coil including a secondary side winding connected at one end to the socket and connected at the other end to a first drive wire, and a primary side winding connected at one end to a second drive wire and connected at the other end to a third drive wire through a discharge gap, a core inserted into the coil, and a resin filled between the core and the primary side winding and the secondary side winding, wherein the secondary side winding and the primary side winding are aligned side; and a capacitor connected between the second drive wire and the third drive wire, wherein the transformer and the socket are aligned side by side.

5. A discharge lamp lighting apparatus, comprising:

a socket adapted to receive a discharge bulb;

a transformer having a coil including a secondary side winding connected at one end to the socket, connected at the other end to a first drive wire, and a primary side winding connected at one end to a second drive wire, connected at the other end to a third drive wire through a discharge gap, a core inserted into the coil, and a resin filled between the core and the primary side winding, the secondary side winding; and a capacitor connected between the second drive wire and the third drive wire, wherein the transformer includes a bobbin wound with the primary side winding and the secondary side winding, a bar-like core inserted into a center of the bobbin, and a gap between the bar-like core and the secondary side winding is enlarged toward one end connected to the socket, and a resin filled in the gap.

6. The discharge lamp lighting apparatus according to claim 5, wherein the transformer has a structure that the primary side winding is wound on the secondary side winding.

7. The discharge lamp lighting apparatus according to claim 6, wherein the transformer has a structure that the secondary side winding is more protruded than the core at the high voltage generating side, at least the high voltage generating side of the core and the secondary side winding is covered with the resin.

8. The discharge lamp lighting apparatus according to claim 5, wherein the transformer is composed of a bobbin made of resin having a cavity at a center, an opening at an end of the secondary side winding of the side not generating the high voltage, and a bottomed cavity engaged with the primary side winding at a periphery of the cavity.

9. The discharge lamp lighting apparatus according to claim 8, wherein the primary side winding is composed of a spring material.

10. The discharge lamp lighting apparatus according to claim 5, wherein the transformer has a winding structure that the secondary side winding and the primary side winding are aligned side by side.

11. A discharge lamp lighting apparatus, comprising:

a socket adapted to receive a discharge bulb;

a transformer having a coil including a secondary side winding connected at one end to the socket, connected at the other end to a first drive wire, and a primary side winding connected at one end to a second drive wire, connected at the other end to a third drive wire through a discharge gap, a core inserted into the coil, and a resin filled between the core and the primary side winding, the secondary side winding; and a capacitor connected between the second drive wire and the third drive wire, wherein the transformer includes a bobbin wound with the primary side winding and the secondary side winding and having a predetermined diameter, a bar-like core inserted into a center of the bobbin and having a taper shape in which the diameter thereof becomes small toward one end connected to the socket of the secondary side winding, and a resin filled in the gap between the bar-like core and the bobbin.

12. The discharge lamp lighting apparatus according to claim 11, wherein the transformer has a structure that the primary side winding is wound on the secondary side winding.

13. The discharge lamp lighting apparatus according to claim 12, wherein the transformer has a structure that the secondary side winding is more protruded than the core at the high voltage generating side, at least the high voltage generating side of the core and the secondary side winding is covered with the resin.

14. The discharge lamp lighting apparatus according to claim 11, wherein the transformer is composed of a bobbin made of resin having a cavity at a center, an opening at an end of the secondary side winding of the side not generating the high voltage, and a bottomed cavity engaged with the primary side winding at a periphery of the cavity.

15. The discharge lamp lighting apparatus according to claim 14, wherein the primary side winding is composed of a stainless steel.

16. The discharge lamp lighting apparatus according to claim 11, wherein the transformer has a winding structure that the secondary side winding and the primary side winding are aligned side by side.

* * * * *